US007536127B2

(12) United States Patent
Watanabe

(10) Patent No.: US 7,536,127 B2
(45) Date of Patent: May 19, 2009

(54) DEVELOPING DEVICE ADJUSTMENT METHOD

(75) Inventor: Masaru Watanabe, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 86 days.

(21) Appl. No.: 11/715,734

(22) Filed: Mar. 8, 2007

(65) Prior Publication Data

US 2007/0217802 A1 Sep. 20, 2007

(30) Foreign Application Priority Data

Mar. 20, 2006 (JP) ..... 2006-076040

(51) Int. Cl.
*G03G 15/06* (2006.01)
*G03G 15/10* (2006.01)

(52) U.S. Cl. ..... 399/55; 399/58

(58) Field of Classification Search ..... 399/53, 399/55, 58, 60

See application file for complete search history.

(56) References Cited

U.S. PATENT DOCUMENTS 5,081,491 A * 1/1992 Lux et al. ..... 399/60
6,134,397 A * 10/2000 Shimazaki et al. ..... 399/55
6,285,840 B1 * 9/2001 Budnik et al. ..... 399/55 X
6,917,780 B2 * 7/2005 Ozawa et al. ..... 399/60 X

FOREIGN PATENT DOCUMENTS

JP 2005-55841 3/2005

* cited by examiner

*Primary Examiner*—Sandra L Brase
(74) *Attorney, Agent, or Firm*—Jordan and Hamburg LLP

(57) ABSTRACT

A method for adjusting a developing device including a magnetic roll for holding a two-component developer composed of a carrier and toner filled in a developing tank in a brush state, and a developing roll for developing an electrostatic latent image formed in an image carrier by holding toner conveyed from the magnetic roll, includes a bias voltage adjustment step for adjusting a conveyance amount of toner from the magnetic roll to the developing roll by adjusting bias voltages applied to the magnetic roll and the developing roll respectively, and a mixing ratio adjustment step for adjusting a conveyance amount of the toner by adjusting a mixing ratio of the two-component developer.

4 Claims, 7 Drawing Sheets

DEVELOPING DEVICE ADJUSTMENT METHOD

BACKGROUND OF THE INVENTION

1. Field of the Invention

The present invention relates to a method for adjusting a developing device including a magnetic roll for holding a two-component developer composed of a carrier and toner filled in a developing tank in a brush state, and a developing roll for developing an electrostatic latent image formed in an image carrier by holding toner conveyed from the magnetic roll, in which there is provided a bias voltage adjustment step for adjusting a conveyance amount of toner from the magnetic roll to the developing roll by adjusting bias voltages applied to the magnetic roll and the developing roll respectively.

2. Description of the Related Art

As a developing device incorporated in an image forming apparatus of an electrophotographic system, Japanese Unexamined Patent Publication No. 2005-55841 proposes a developing method as follows with objects of constantly stabilizing a toner layer thickness on a developing roller over a long period of time without complicating a developing device, and maintaining a stable image without concentration changes.

In the developing method, elicited on an image carrier is a toner layer thickness detecting pattern arranged with a solid pattern using a toner layer formed in the second round from the start of applying a developing bias to a developing roll and a halftone pattern using a toner layer formed during the subsequent one rotation, and a toner concentration of the toner layer thickness detecting pattern on the image carrier or the toner layer thickness detecting pattern transferred to a transfer body is detected by a concentration sensor so as to control a differential voltage of bias voltages between a magnetic roll and a developing roll, i.e. a conveyance bias voltage, on the basis of a detected toner concentration.

However, in the above stated conventional technique, an adjustment is made on condition that an electrification amount of toner filled in a developing tank is controlled within a range of an ideal electrification amount, causing a problem that an adjustment cannot be made appropriately if an electrification amount of the toner is changed.

For example, a concentration of a halftone pattern is detected to set a conveyance bias voltage on the basis of a detected result, which generates leakage between the developing roll and the magnetic roll depending on an electrification amount of toner due to an adjusted conveyance bias value which was made too high, causing occasional image defects such as a black point.

Moreover, a narrowed interval between the developing roll and the magnetic roll causes a conveyance problem of toner, and there is a possibility of generating toner scattering and developer leakages. Oppositely, if the conveyance bias voltage is made too low, it is impossible for a toner supply amount to catch up with a toner consumption amount in the developing roll, and there is a possibility that a developing ghost is generated to have an effect of a previous development history on a subsequent development.

SUMMARY OF THE INVENTION

It is an aspect of the present invention to provide a method for adjusting a developing device capable of maintaining stable image quality by appropriately adjusting a toner amount conveyed to a developing roll, in consideration with the above stated conventional drawbacks.

In order to achieve the above object, the developing device adjustment method according to the present invention includes a developing device provided with a magnetic roll for holding a two-component developer composed of a carrier and toner to be filled in a developing tank in a brush state, and a developing roll for developing an electrostatic latent image formed in an image carrier by holding toner conveyed from the magnetic roll, having a bias voltage adjustment step for adjusting a conveyance amount of toner from the magnetic roll to the developing roll by adjusting bias voltages applied to the magnetic roll and the developing roll respectively, and a mixing ratio adjustment step for adjusting a conveyance amount of the toner by adjusting a mixing ratio of the two-component developer.

Also, the mixing ratio adjustment step is preferably executed if it is impossible to adjust a conveyance amount of the toner to a predetermined conveyance amount in the bias voltage adjustment step.

Further preferably, the bias voltage adjustment step is provided with a first bias voltage adjustment step for adjusting a conveyance amount of the toner by an adjustment of a bias voltage applied to the magnetic roll so as to allow a concentration of a solid pattern formed in the image carrier or a solid pattern transferred to the transfer body to be a predetermined concentration at least in a state that a predetermined low bias voltage is applied to the developing roll.

Further preferably, the bias voltage adjustment step is provided with a first bias voltage adjustment step for adjusting a conveyance amount of the toner by an adjustment of a bias voltage applied to the magnetic roll so as to allow a concentration of a solid pattern formed in the image carrier or a solid pattern transferred to the transfer body to be a predetermined concentration at least in a state that a predetermined low bias voltage is applied to the developing roll, in which the mixing ratio adjustment step is executed after adjusting a conveyance amount of the toner to a predetermined conveyance amount in the first bias voltage adjustment step.

Further preferably, the bias voltage adjustment step is provided with a first bias voltage adjustment step for adjusting a conveyance amount of the toner by an adjustment of a bias voltage applied to the magnetic roll so as to allow a concentration of a solid pattern formed in the image carrier or a solid pattern transferred to the transfer body to be a predetermined concentration at least in a state that a predetermined low bias voltage is applied to the developing roll, and a second bias voltage adjustment step for adjusting bias voltages applied to the magnetic roll and the developing roll respectively while maintaining a differential voltage of the bias voltages in a constant state so that a concentration of a predetermined halftone pattern formed in the image carrier or a predetermined halftone pattern transferred to the transfer body is brought into a predetermined concentration after executing the first bias voltage adjustment step, in which the mixing ratio adjustment step is executed after completing an adjustment by the bias voltage adjustment step.

Additionally, inventions other than the above will be specifically indicated by referring to embodiments below.

DESCRIPTION OF THE PREFERRED EMBODIMENTS

Figure 2:
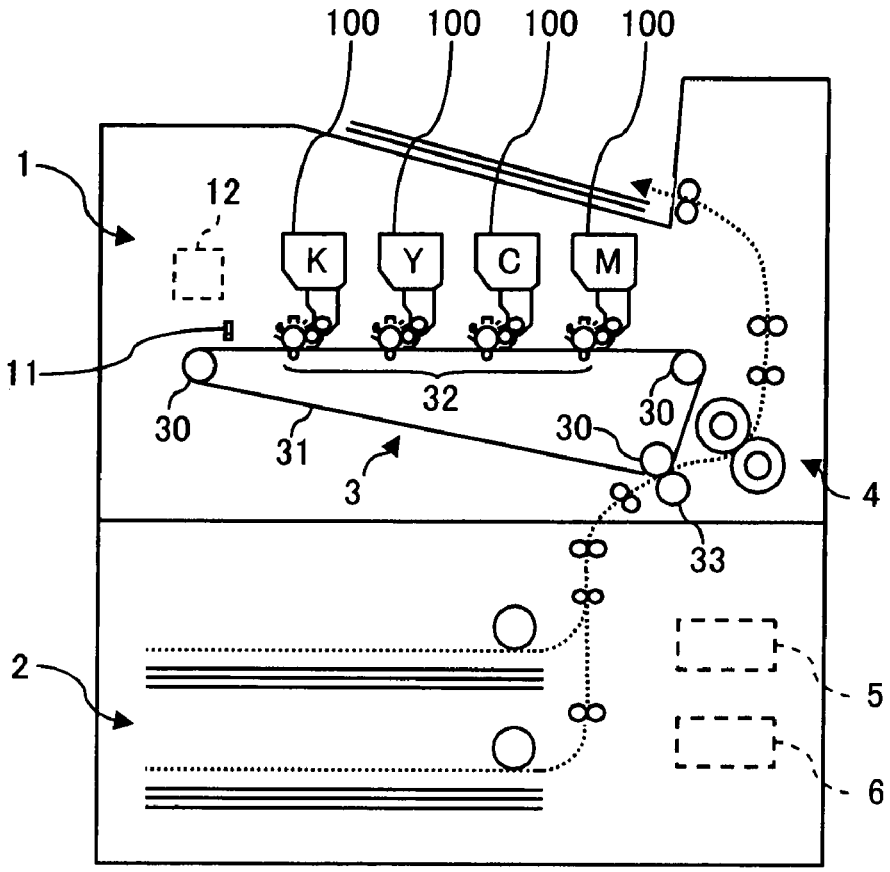
FIG. 2 is an explanatory diagram of a printer incorporated with the developing device to which the developing device adjustment method according to the present invention is applied.

A developing device adjustment method according to the present invention will be explained below. As shown in FIG. 2, a printer, as an example of an image forming apparatus of an electrophotographic system provided with the developing device according to the present invention, has a configuration to include an image forming unit 1 for forming toner images of respective color components of M (magenta), C (cyan), Y (yellow) and K (black) on the basis of a print job inputted from an external device, a paper feeding unit 2 composed of a paper tray for supplying, conveying and ejecting a paper as a recording medium and a conveyance roller or the like, a transfer body 31 in an endless belt state supported by three rollers 30, a transfer unit 3 configured with a plurality of transfer rollers 32 and 33 arranged in contact with the transfer body 31, a fixing unit 4 for processing fixation of a recording medium with a transferred toner image, an interface unit 5 for sending and receiving data with the external device, and a system control unit 6 having a microcomputer for integrally controlling the printer.

Figure 1:
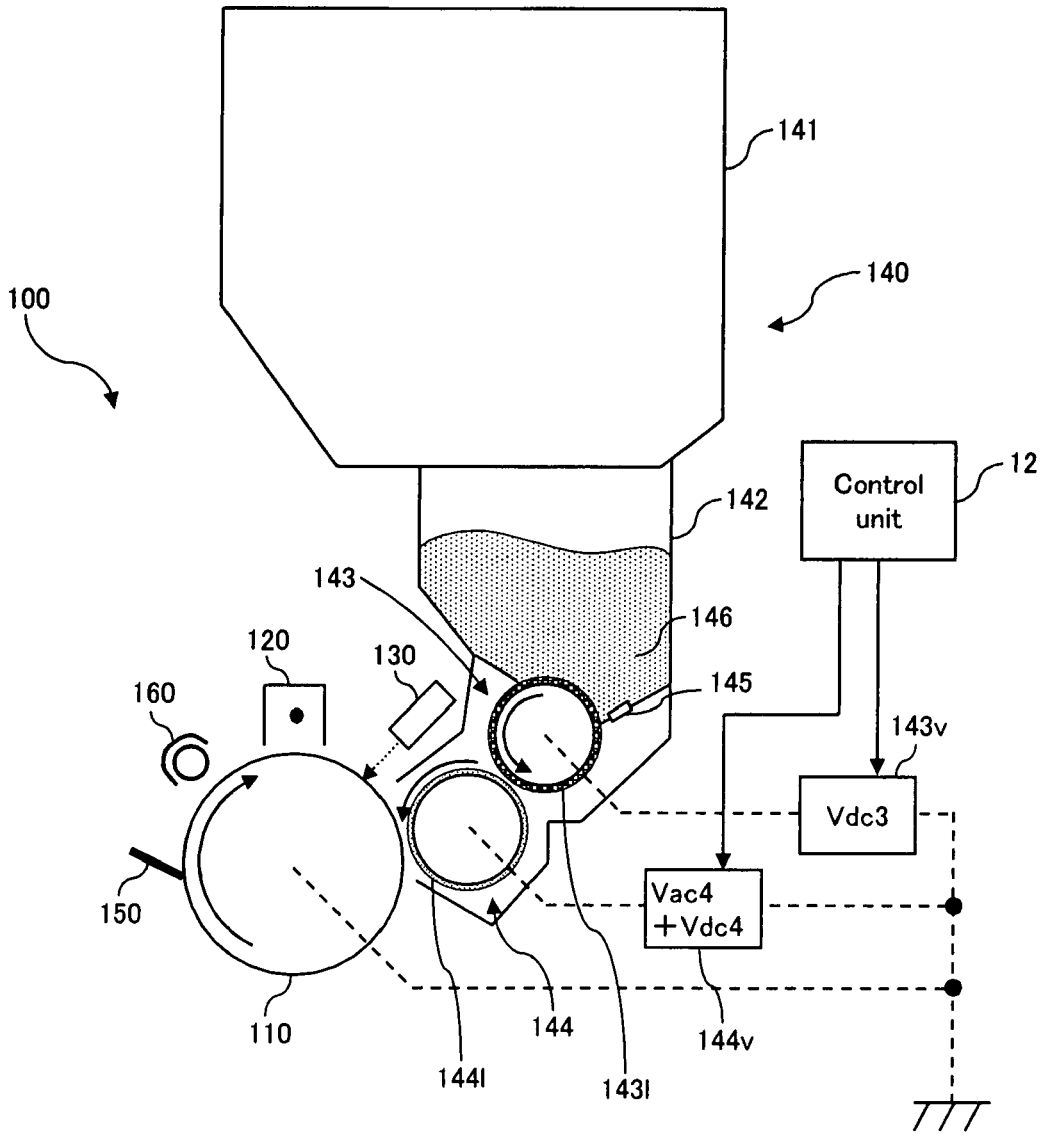
FIG. 1 is an explanatory diagram of a developing device to which a developing device adjustment method according to the present invention is applied.

The image forming unit 1 is composed of four photoreceptor units 100 corresponding to respective colors of M (magenta), C (cyan), Y (yellow) and K (black) arranged along a circumferential direction of the transfer body 31, a toner concentration sensor 11 for detecting a concentration of the respective colors on the basis of an amount of reflected light from a reference toner pattern of each of the colors carried to the transfer body 31 so as to maintain a concentration of a toner image in a predetermined concentration, and a control unit 12 for controlling the image forming unit 1, in which each of the photoreceptor units 100 has an image carrier 110 arranged with, along a circumferential direction of the image carrier 110, an electrostatic charger 120, an exposure head 130, a developing device 140, a cleaner 150, and an eraser lamp 160 or the like, as shown in FIG. 1.

The image carrier 110 is composed of a photoreceptor drum having a photoreceptor with a vapor-deposited amorphous silicone layer which is a photoconductor to indicate a positive electrification property on the surface of an aluminum-made cylinder, having a configuration to be positively electrified from the electrostatic charger 120 so that a charge in an exposed portion is grounded via the cylinder by exposure from the exposure head 130.

Figure 3:
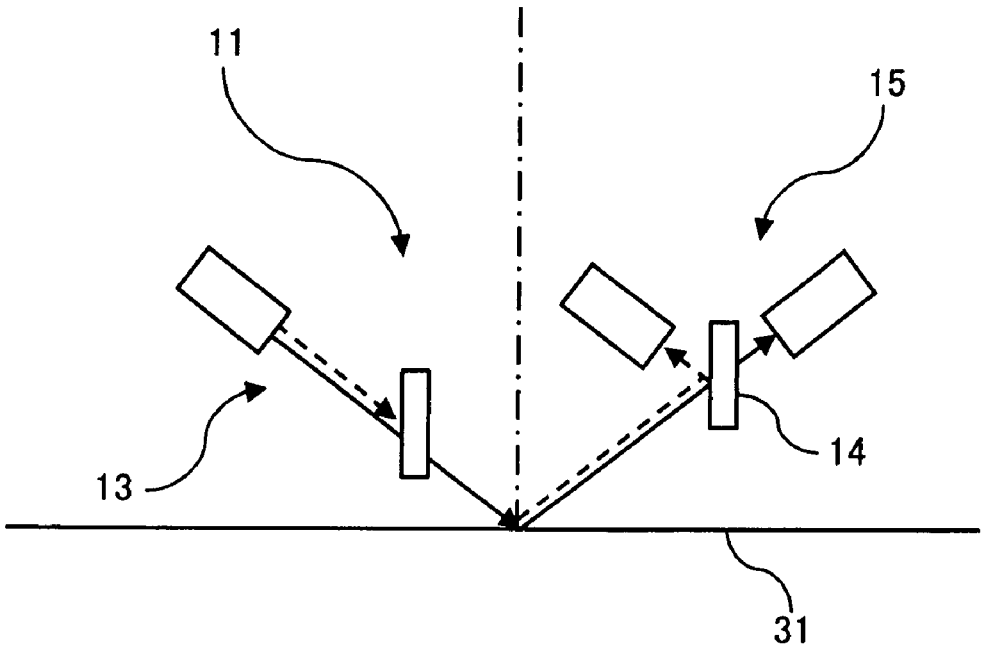
FIG. 3 is an explanatory diagram of a toner concentration sensor for detecting a toner concentration on a transfer body.

The toner concentration sensor 11 is arranged in a downstream side of the photoreceptor unit 100 which was arranged along a circumferential direction of the transfer body 31. More specifically, as shown in FIG. 3, the toner concentration sensor 11 has a configuration to include a light projection unit 13 for projecting single polarized light at a predetermined inclined angle with respect to a normal line direction of the transfer body 31, a polarized light separating unit 14 arranged in an opposite side of the light projection unit 13 relative to the normal line direction for separating reflected light from the transfer body 31 into first polarized light being the same with the projected light and second polarized light being different from the projected light, and first and second light receiving units 15 for receiving the first and second polarized light, in which a toner concentration is detected by a difference in a light amount between the first and second polarized light.

The developing device 140 provided for each of the photoreceptor units 100 in the respective colors of M (magenta), C (cyan), Y (yellow) and K (black) has a configuration as shown in FIG. 1, including a toner cartridge 141 filled with toner corresponding to each of the colors, a developing tank 142 for stirring toner supplied from the toner cartridge 141 with a carrier, a magnetic roll 143 for holding a magnetic brush 143*l* to form a two-component developer 146 composed of a carrier and toner filled in the developing tank 142 in a brush state, and a developing roll 144 for developing an electrostatic latent image formed in the image carrier 110 by holding toner conveyed from the magnetic roll 143 as a toner thin layer 144*l*.

The magnetic roll 143 is composed of a rotating sleeve including a fixed magnet roller with alternately magnetized N pole and S pole, and connected to a high voltage circuit 143*v* to apply a DC bias voltage Vdc3 to a rotational axis thereof.

The developing roll 144 is composed of aluminum with uniform electrification, and connected to a high voltage circuit 144*v* which applies an AC bias voltage Vac4 superimposed by a DC bias voltage Vdc4 and a DC bias voltage Vdc4 to a rotational axis thereof.

The control unit 12 controls the high voltage circuits 143*v* and 144*v* and adjusts a conveyance amount of toner from the magnetic roll 143 to the developing roll 144 by adjusting a conveyance bias voltage ΔVc which is a differential voltage of the DC bias voltages applied to the magnetic roll 143 and the developing roll 144 respectively.

The control unit 12 is configured to execute a calibration control composed of a bias voltage adjustment step including a first bias voltage adjustment step and a second bias voltage adjustment step, and a mixing ratio adjustment step executed in accordance with necessity, by a predetermined period which was set in advance, i.e., at the point of time when cumulative operation time of the developing device 140 reaches predetermined time, or at the point of time when a cumulative number of prints reach a predetermined number of prints.

That is, when the calibration control starts by the predetermined period, the first bias voltage adjustment step for adjusting the DC bias voltage Vdc3 applied to the magnetic roll 143 is executed to allow a concentration of a solid pattern formed in the image carrier 110 or a solid pattern transferred to the transfer body 31 to be a predetermined concentration, at least in a state that a predetermined low DC bias voltage Vdc4 (L) is applied to the developing roll 144.

If it is impossible in the first bias voltage adjustment step to adjust a conveyance amount of the toner to a predetermined conveyance amount, the mixing ratio adjustment step for adjusting a mixing ratio of the two-component developer 146 is executed to adjust a conveyance amount of the toner. Thereafter, the first bias voltage adjustment step is executed again to certainly adjust a conveyance amount of the toner to a predetermined conveyance amount.

Furthermore, after executing the first bias voltage adjustment step, executed is the second bias voltage adjustment step for adjusting bias voltages applied to the magnetic roll 143 and the developing roll 144 respectively while maintaining the conveyance bias voltage ΔVc which is a differential voltage of the bias voltages in a constant state, so that a concentration of a predetermined halftone pattern formed in the image carrier 110 or a predetermined halftone pattern transferred to the transfer body 31 is made to be a predetermined concentration.

The bias voltage adjustment step is not limited to the adjustment method as stated above, and another adjustment method may be employed such as an adjustment method in which a toner layer thickness detecting pattern for use in detecting a toner layer thickness on the developing roller 144 is formed with arrangements of a solid pattern using a toner layer formed on the image carrier 110 in the second round of the developing roller 144 from the start of applying a developing bias of the developing roller 144, and a halftone pattern using a toner layer formed during the subsequent one rotation of the developing roller 144, and a toner concentration of the formed toner layer thickness detecting pattern on the image carrier 110 or the toner layer thickness detecting pattern on the transfer body 31 transferred from the image carrier 110 is detected by the toner concentration sensor 11 in order to control a toner layer on the developing roller 144 to have a predetermined layer thickness using a detected toner concentration, in the same manner with an adjustment method described in Japanese Unexamined Patent Publication No. 2005-55841.

In the case of having an inappropriate electrification amount of toner included in the two-component developer or the like, it is occasionally impossible to complete the bias voltage adjustment step due to an insufficient adjustment of a conveyance amount of toner from the magnetic roll to the developing roll by simply adjusting bias voltages applied to the magnetic roll and the developing roll respectively. However, according to the above stated configuration, an electrification amount of the toner is adjusted by an adjustment of a mixing ratio of the two-component developer in the mixing ratio adjustment step, so that a conveyance amount of the toner can be certainly adjusted.

Details will be described below. The control unit 12 fixes the DC bias voltage Vdc4 to a predetermined low DC bias voltage Vdc4 (L) which is close to a minimum output voltage without changing the AC bias voltage Vac4 applied to the developing roll 144 for each of the photoreceptor units 100 in the respective colors at the point of time when cumulative operation time of the developing device 140 reaches predetermined time or a cumulative number of prints reach a predetermined number of prints, while applying several different patterns of the DC bias voltage Vdc3 to the magnetic roll 143, in order to form a toner image which becomes a solid pattern in each of the patterns in the image carrier 110 for transfer to the transfer body 31.

For monitoring a conveyance amount of toner from the magnetic roll 143 to the developing roll 144, a toner concentration value in each of toner images is detected by the toner concentration sensor 11 to obtain a DC bias voltage Vdc3 (O) which brings a detected toner concentration value to a predetermined toner concentration value at the time of forming a solid pattern stored in a storage unit of the control unit 12, so that a conveyance amount of the toner is adjusted.

According to the above configuration, a bias voltage applied to the magnetic roll is adjusted to bring a concentration of the solid pattern to a predetermined concentration in a state that a predetermined low bias voltage is applied to the developing roll, i.e., in a state of having low development efficiency, so that conditions such as excessive toner conveyed to the developing roll can be eliminated.

If it is impossible to obtain the DC bias voltage Vdc3 (O) which brings a concentration of a solid pattern formed in the image carrier 110 or a solid pattern transferred to the transfer body 31 to a predetermined concentration, i.e., if it is impossible to make an adjustment, the mixing ratio adjustment step for adjusting a mixing ratio of the two-component developer 146 (referred to as a T/C hereinafter) is executed to adjust a conveyance amount of toner, followed by executing the bias voltage adjustment step again to adjust a conveyance amount of the toner.

Figure 4:
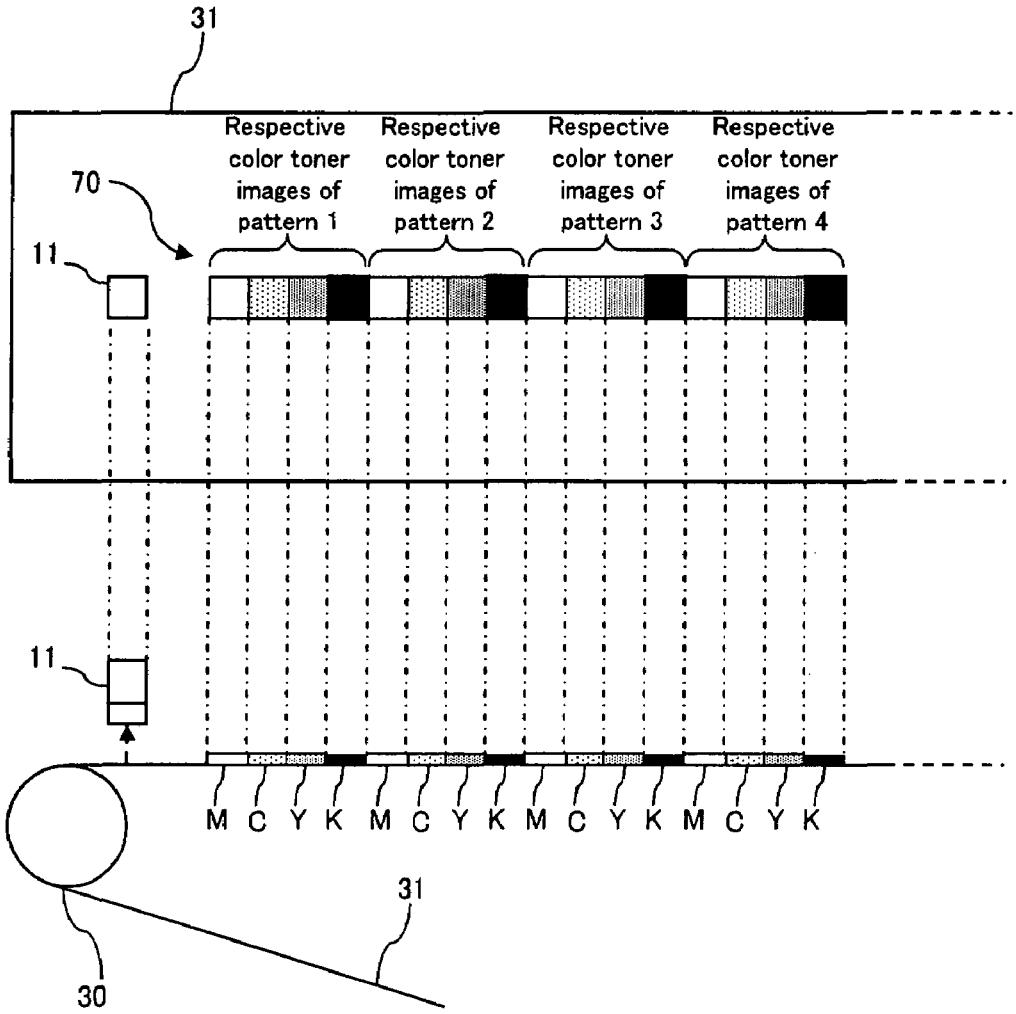
FIG. 4 is an explanatory diagram of a toner image formed on the transfer body.

For more details, the DC bias voltage Vdc4 is initially fixed to a predetermined low DC bias voltage Vdc4 (L) which is close to a minimum output voltage in executing the bias voltage adjustment step, and the bias voltage Vdc3 ranged from a pattern 1 to a pattern 4 is applied to the magnetic roll 143 to form four kinds of solid pattern toner images in the image carrier 110, so that the toner images are carried to the transfer body 31 to detect a toner concentration value for each of the four kinds of the solid patterns by the toner concentration sensor 11 as shown in FIG. 4.

Figure 5:
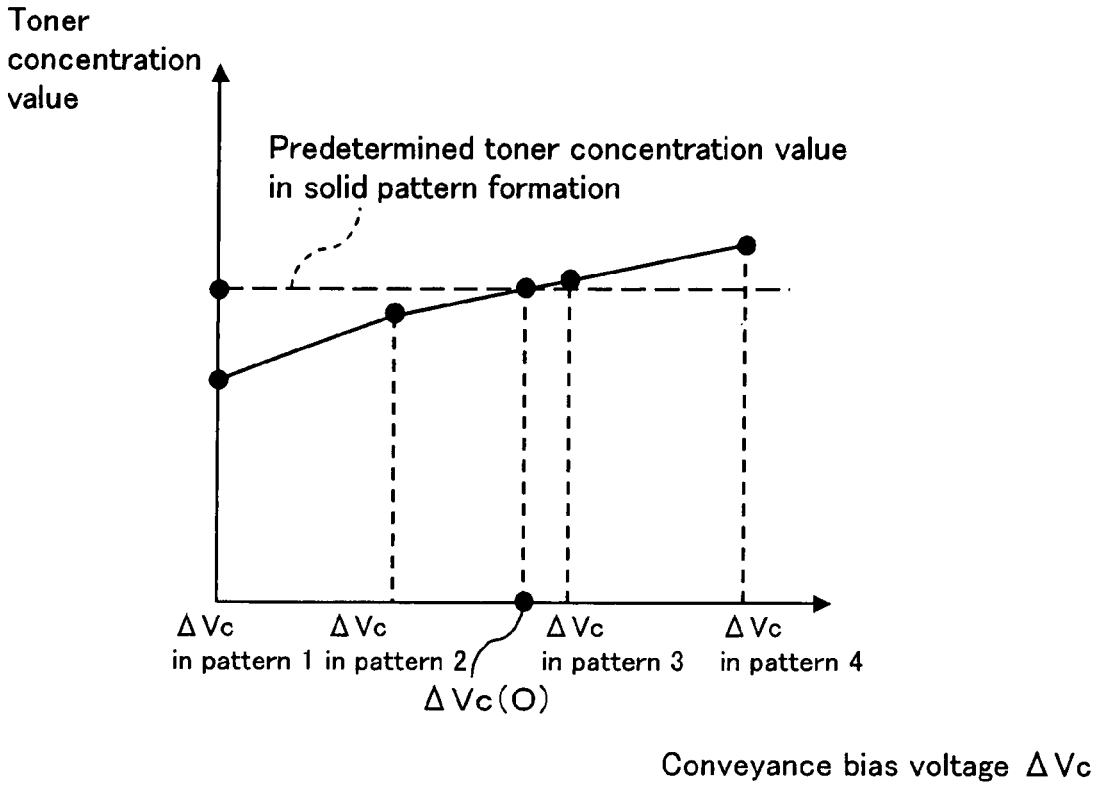
FIG. 5 is a graph showing a relationship between a conveyance bias voltage and a toner concentration value of a solid pattern toner image on the transfer body (a conveyance amount of toner to a developing roll)

As shown in FIG. 5, the conveyance bias voltage ΔVc with respect to each of the four kinds of the solid patterns and a characteristic curve obtained from a detected toner concentration value are used to obtain an optimum conveyance bias voltage ΔVc (O) corresponding to a predetermined toner concentration value at the time of forming a solid pattern stored in the storage unit of the control unit 12, and a DC bias voltage Vdc3 (O) is obtained by the optimum conveyance bias voltage ΔVc (O) and the DC bias voltage Vdc4 (L) in order to adjust a conveyance amount of the toner to a predetermined conveyance amount by applying each of the DC bias voltages.

In the case of having a great change in conveyance characteristics of toner conveyed from the magnetic roll 143 to the developing roll 144 caused by the increase and decrease of a toner electrification amount of the two-component developer 146 in the developing tank 142 or carrier coat peeling or the like, and if it is impossible to obtain the optimum conveyance bias voltage ΔVc (O) without outputting the DC bias voltage Vdc3 deviated from an output range of the high voltage circuit 143*v*, the conveyance characteristics of the toner is adjusted by executing the mixing ratio adjustment step, followed by executing the bias voltage adjustment step again to obtain the optimum conveyance bias voltage ΔVc (O), so that a conveyance amount of the toner is adjusted.

For easiness and response or the like in adjusting a conveyance amount of the toner, the bias voltage adjustment step should be desirably used rather than the mixing ratio adjustment step. Furthermore, for image quality maintenance achieved by preventing generation of toner scattering, black points, white points, and development ghosts, and for economic efficiencies such as energy saving and durability of members, it is not preferable to apply a bias voltage which is too high or too low, and the bias voltage should be desirably applied within an output range obtained through experiments or the like.

However, there is a possibility that the bias voltage adjustment step cannot be completed due to inability in the bias voltage within the output range to adjust a conveyance amount of the toner to a predetermined conveyance amount. According to the above stated configuration, the bias voltage adjustment step is initially executed, and if it is impossible to complete an adjustment in the bias voltage adjustment step, a mixing ratio of the two-component developer is adjusted in the mixing ratio adjustment step so as to adjust an electrification amount of the toner, thereby a conveyance amount of the toner can be brought into a predetermined conveyance amount by the bias voltage within the output range.

Figure 6:
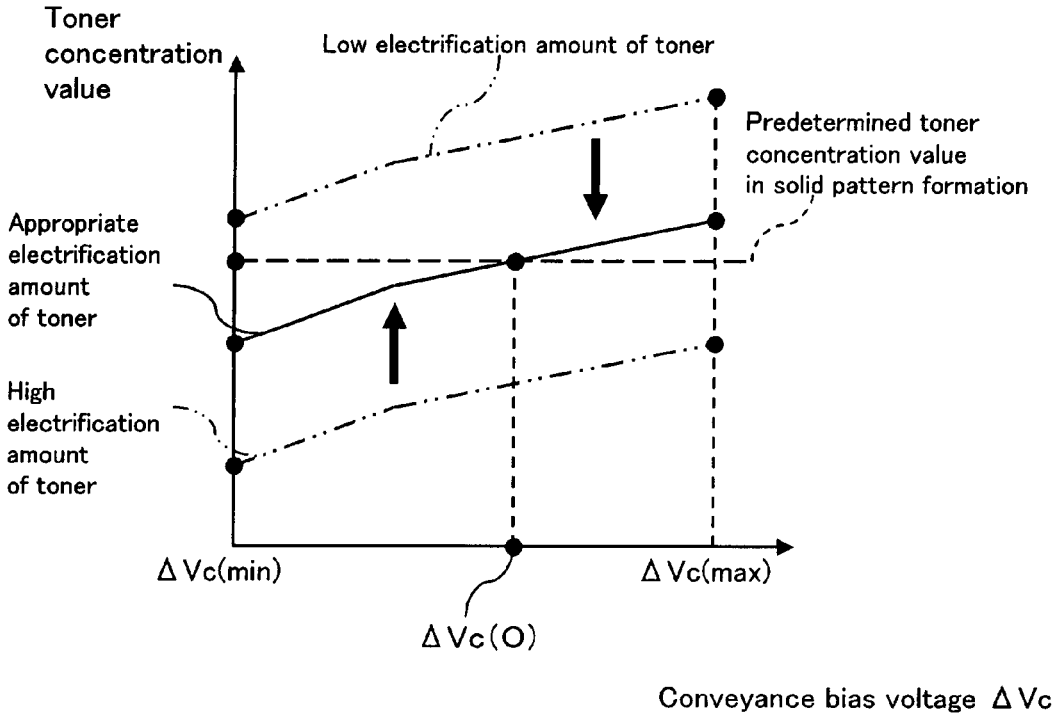
FIG. 6 is a graph showing conveyance characteristics in an amount of toner conveyed to the developing roll.

The mixing ratio adjustment step will be described. As shown in FIG. 6, since the increase in conveyance characteristics of the toner is exhibited when a toner electrification amount in the two-component developer 146 is decreased, even a minimum conveyance bias voltage ΔVc (min) causes excessive toner to be conveyed. Oppositely, the decrease in conveyance characteristics of the toner is exhibited when the toner electrification amount is increased, so that even a maximum conveyance bias voltage ΔVc (max) does not allow sufficient toner to be conveyed. Therefore, on the basis of a relationship between the characteristic curve obtained when the bias voltage adjustment step is executed and a toner concentration in the developing tank 142 detected by the toner concentration sensor 145 arranged in the developing tank 141, i.e. the T/C, the control unit 12 changes the T/C by controlling a supply amount of toner to bring the toner electrification amount to a predetermined electrification amount, so that the conveyance characteristics of the toner are changed.

To be more specific, if a toner electrification amount is low, the control unit 12 changes the T/C by reducing a supply amount of toner from the toner cartridge 141 or without toner supply to form an image or forcedly discard so as to obtain a solid pattern in a predetermined concentration by adjusting the conveyance bias voltage ΔVc within an output range of the high voltage circuit 143*v*, and a toner electrification amount is increased further in accordance with necessity by increasing a scattering amount of the two-component developer 146.

Furthermore, if a toner electrification amount is high, the control unit 12 changes the T/C by increasing a supply amount of toner from the toner cartridge 141 so as to obtain a solid pattern in a predetermined concentration by an adjustment of the conveyance bias voltage ΔVc within an output range of the high voltage circuit 143*v*, followed by further reducing a scattering amount of the two-component developer 146 in accordance with necessity and forcedly discarding toner with high electrification in order to decrease a toner electrification amount.

Forced discarding of the toner will be described. Since it is difficult for toner with a large electrification amount to decrease the electrification amount by supplying new toner, it is necessary to forcedly discard toner which was excessively electrified. At the time of forming an image, the image carrier 110 is electrified by the electrostatic charger 120 to attach toner from the developing roll 144 to an electrostatic latent image portion exposed in the exposure head 130 for development. However, at the time of forcedly discarding toner, a large amount of toner from the developing roll is attached to the image carrier 110 while maintaining a surface potential of the image carrier 110 in a low state without electrification by the electrostatic charger 120, and cleaning by the cleaner 150 is performed to discard the toner.

Although the image forming apparatus here is intended to have a switching mechanism to separate the image carrier 110 from the transfer body 31 for switching at the time of the forced discard as stated above in order to prevent toner attached to the image carrier 110 from being transferred to the transfer body 31, if the switching mechanism is not provided, toner attached to the image carrier 110 may be transferred to the transfer body 31 in the configuration to discard residual toner on the transfer body 31 by cleaning using a cleaner not shown for cleaning the residual toner.

A process of executing the bias voltage adjustment step again after changing the T/C in the mixing ratio adjustment step so as to obtain the optimum conveyance bias voltage ΔVc (O) is repeated, so that a concentration of a solid pattern transferred to the transfer body 31 is adjusted to a predetermined concentration.

Furthermore, after a concentration of a solid pattern was made to be a predetermined concentration, the second bias voltage adjustment step is executed to adjust the bias voltages Vdc3 and Vdc4 while maintaining the optimum conveyance bias voltage ΔVc (O) so as to bring a concentration of a predetermined halftone pattern formed in the image carrier 110 or a predetermined halftone pattern transferred to the transfer body 31 to a predetermined concentration, and the calibration control is finished.

Another embodiment will be explained below.

In the configuration of the above stated embodiment, the bias voltage adjustment step has the first bias voltage adjustment step and the second bias voltage adjustment step, and if it is impossible to make an adjustment in the first bias voltage adjustment step, the mixing ratio adjustment step is executed so as to execute the first bias voltage adjustment step again for adjusting a conveyance amount of toner, followed by executing the second bias voltage adjustment step. However, the mixing ratio adjustment step may be executed in the configuration after completing an adjustment within a range allowed in the bias voltage adjustment step, i.e., after completing the first bias voltage adjustment step and the second bias voltage adjustment step.

The bias voltage adjustment step occasionally causes a bias voltage applied to the magnetic roll to be adjusted close to an upper limit or a lower limit of an output range thereof, and if an electrification amount of toner contained in the two-component developer is changed due to frequent image formation with a large or small amount of toner consumption, there is a possibility that a conveyance amount of toner cannot be adjusted to a predetermined conveyance amount in the bias voltage adjustment step at the time of executing the subsequent calibration.

However, since a conveyance amount of the toner is brought into a predetermined conveyance amount by applying a bias voltage within the output range, no immediate effect is exhibited in the mixing ratio adjustment step which adjusts an electrification amount of the toner by adjusting a mixing ratio of the two-component developer, thereby it takes time to bring a conveyance amount of the toner to a predetermined conveyance amount, and the toner needs to be consumed forcedly in the case of having a large electrification amount of the toner, so that an amount of toner consumption is increased.

According to the above stated configuration, an electrification amount of the toner is appropriately adjusted by gradually adjusting a mixing ratio of the two-component developer in the mixing ratio adjustment step before executing the subsequent calibration, so that a conveyance amount of the toner can be brought into a predetermined conveyance amount by simply making an adjustment in the bias voltage adjustment step at the time of executing the subsequent calibration.

Figure 7:
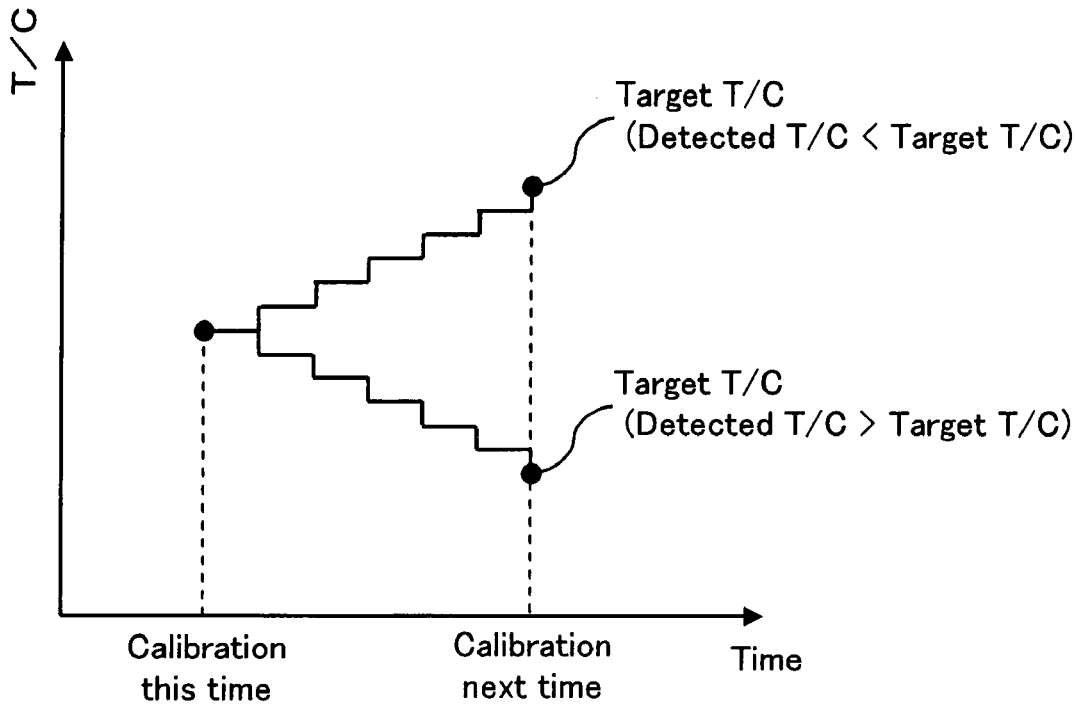
FIG. 7 is a graph to explain a mechanism of adjusting a mixing ratio of a two-component developer to a target mixing ratio.

In this case, it is desirable to make a stepwise adjustment at the time of executing the subsequent calibration in the mixing ratio adjustment step so as to achieve the target T/C as shown in FIG. 7. Moreover, a stepwise adjustment should be preferably made by a plurality of calibration periods so as to achieve the target T/C.

In the configuration of the above stated embodiment, the bias voltage adjustment step has the first bias voltage adjustment step and the second bias voltage adjustment step, and if it is impossible to make an adjustment in the first bias voltage adjustment step, the mixing ratio adjustment step is executed so as to execute the first bias voltage adjustment step again for adjusting a conveyance amount of toner, followed by executing the second bias voltage adjustment step. However, the mixing ratio adjustment step may be executed in the configuration after adjusting a conveyance amount of the toner to a predetermined conveyance amount in the first bias voltage adjustment step, followed by executing the second bias voltage adjustment step.

The first bias voltage adjustment step occasionally causes a bias voltage applied to the magnetic roll to be adjusted close to an upper limit or a lower limit of an output range thereof, and output of a bias voltage close to an upper limit or a lower limit of the output range is less stable in general, and a conveyance amount of the toner easily deviates from a predetermined conveyance amount. Moreover, it is impossible to cope with the case in which higher output or lower output is required in the bias voltage for a gradation adjustment or the like for example, following to the first bias voltage adjustment step.

According to the above stated configuration, if an adjusted bias voltage applied to the magnetic roll is less stable after adjusting a conveyance amount of the toner to a predetermined conveyance amount in the first bias voltage adjustment step, and if higher output or lower output is required in the bias voltage for further adjustments without having a predetermined variation width required for the further adjustments, or the like, a mixing ratio of the two-component developer is adjusted in the mixing ratio adjustment step to allow an adjustment of an electrification amount of the toner so that it is made possible to make an adjustment to the bias voltage having stability within the output range and the predetermined variation width.

In this case, if there is a great change in conveyance characteristics of toner from the magnetic roll 143 to the developing roll 144 due to the mixing ratio adjustment step to be executed, it is further preferable in the configuration to execute the first bias voltage adjustment step again, followed by executing the second voltage adjustment step.

Although a photoreceptor drum having a photoreceptor with a vapor-deposited amorphous silicone layer being a positively electrified photoconductor on the surface of an aluminum-made cylinder is employed as the image carrier 110 in the above stated configuration, an OPC drum with a photoreceptor of an organic photoconductor and another kind of a photoconductive semiconductor drum with a selenium photoreceptor or the like may also be employed in the configuration, in which a two-component developer to be employed may be appropriately changed in accordance with electrification characteristics of a photoreceptor.

Although toner images with four different concentration patterns are formed as toner images of a solid pattern and a halftone pattern formed in the image carrier 110 in the above embodiments, there is no particular limitation for the number of patterns and a concentration in the respective patterns, and a toner image of an optimum pattern may be formed in combination with various conditions such as device characteristics, using conditions and costs, in which the bias voltages Vdc3 and Vdc4 applied to the magnetic roll 143 and the developing roll 144 may be adjusted by detecting a toner concentration value of the toner image in each of the patterns.

Each of the above stated embodiments is merely an example of the present invention, and the present invention is not limited to the description of the embodiments, so that the concrete configuration in each of the units can be appropriately modified within a scope of exhibiting operational effects of the present invention, as needless to say.

What is claimed is:

1. A method for adjusting a developing device provided with a magnetic roll for holding a two-component developer composed of a carrier and toner filled in a developing tank in a brush state, and a developing roll for developing an electrostatic latent image formed in an image carrier by holding toner conveyed from the magnetic roll, comprising:

a bias voltage adjustment step for adjusting a conveyance amount of toner from the magnetic roll to the developing roll by adjusting bias voltages applied to the magnetic roll and the developing roll respectively, and a mixing ratio adjustment step for further adjusting the conveyance amount of the toner by adjusting a mixing ratio in the two-component developer which is executed when it is impossible in the bias voltage adjustment step to adjust the conveyance amount of the toner to a predetermined conveyance amount.

2. The method for adjusting the developing device according to claim 1, wherein:

the bias voltage adjustment step includes adjusting a bias voltage applied to the magnetic roll so as to allow a concentration of a solid pattern formed in the image carrier or a solid pattern transferred to a transfer body to be a predetermined concentration at least in a state that a predetermined low bias voltage is applied to the developing roll.

3. A method for adjusting a developing device provided with a magnetic roll for holding a two-component developer composed of a carrier and toner filled in a developing tank in a brush state, and a developing roll for developing an electrostatic latent image formed in an image carrier by holding toner conveyed from the magnetic roll, comprising:

a bias voltage adjustment step for adjusting a conveyance amount of toner from the magnetic roll to the developing roll by adjusting bias voltages applied to the magnetic roll and the developing roll respectively, the bias voltage adjustment step including adjusting a bias voltage applied to the magnetic roll so as to allow a concentration of a solid pattern formed in the image carrier or a solid pattern transferred to a transfer body to be a predetermined concentration at least in a state that a predetermined low bias voltage is applied to the developing roll, and the mixing ratio adjustment step is executed after adjusting the conveyance amount of the toner to a predetermined conveyance amount in the first bias voltage adjustment step; and a mixing ratio adjustment step for further adjusting the conveyance amount of the toner by adjusting a mixing ratio in the two-component developer.

4. A method for adjusting a developing device provided with a magnetic roll for holding a two-component developer composed of a carrier and toner filled in a developing tank in a brush state, and a developing roll for developing an electrostatic latent image formed in an image carrier by holding toner conveyed from the magnetic roll, comprising:

a bias voltage adjustment step for adjusting a conveyance amount of toner from the magnetic roll to the developing roll by adjusting bias voltages applied to the magnetic roll and the developing roll respectively, said bias voltage adjustment step further including a first bias voltage adjustment step for adjusting a conveyance amount of the toner by an adjustment of a bias voltage applied to the magnetic roll so as to allow a concentration of a solid pattern formed in the image carrier or a solid pattern transferred to a transfer body to be a predetermined concentration at least in a state that a predetermined low bias voltage is applied to the developing roll, and a second bias voltage adjustment step for adjusting bias voltages applied to the magnetic roll and the developing roll respectively while maintaining a differential voltage of the bias voltages in a constant state so that a concentration of a predetermined halftone pattern formed in the image carrier or a predetermined halftone pattern transferred to a transfer body is brought into a predetermined concentration after executing the first bias voltage adjustment step, wherein: the mixing ratio adjustment step is executed after completing an adjustment by the bias voltage adjustment step; and a mixing ratio adjustment step for further adjusting the conveyance amount of the toner by adjusting a mixing ratio in the two-component developer.

* * * * *